US006135766A

United States Patent [19]

Takeda et al.

[11] Patent Number: 6,135,766

[45] Date of Patent: Oct. 24, 2000

[54] ROTARY HEARTH FURNACE AND METHOD OF OPERATING THE SAME

[75] Inventors: Kanji Takeda; Yoshitaka Sawa, both of Chiba, Japan

[73] Assignee: Kawasaki Steel Corporation, Japan

[21] Appl. No.: 09/319,003

[22] PCT Filed: Mar. 27, 1998

[86] PCT No.: PCT/JP98/01400

§ 371 Date: May 27, 1999

§ 102(e) Date: May 27, 1999

[87] PCT Pub. No.: WO99/16914

PCT Pub. Date: Apr. 8, 1999

[30] Foreign Application Priority Data

Sep. 30, 1997 [JP] Japan ..... 9-265407

[51] Int. Cl.[7] ..... F27B 9/14

[52] U.S. Cl. ..... 432/138; 432/124; 266/163

[58] Field of Search ..... 432/6, 11, 124, 432/138, 195; 266/162, 163, 173

[56] References Cited

U.S. PATENT DOCUMENTS

| | | | |
|---|---|---|---|
| 2,085,625 | 6/1937 | Andersen | 432/138 |
| 4,181,812 | 1/1980 | Collin | 373/81 |
| 4,597,564 | 7/1986 | Hanewald et al. | 432/138 |
| 4,622,905 | 11/1986 | MacDougall et al. | 110/347 |
| 4,701,214 | 10/1987 | Kaneko et al. | 266/177 |

*Primary Examiner*—Denise L. Ferensic
*Assistant Examiner*—Gregory A. Wilson
*Attorney, Agent, or Firm*—Austin R. Miller

[57] ABSTRACT

A feed stock composed of an iron ore and a solid reducing material is supplied in a movable hearth furnace provided with a unidirectionally movable hearth, stacked on the movable hearth and then subjected to a series of operations of preheating, reduction and discharge. To this end, a feed stock subsequently supplied in such furnace is preheated by utilizing a heat applied by the finished reduced ore and is stacked on the movable hearth.

4 Claims, 3 Drawing Sheets

CONVENTIONAL
FIG. 2
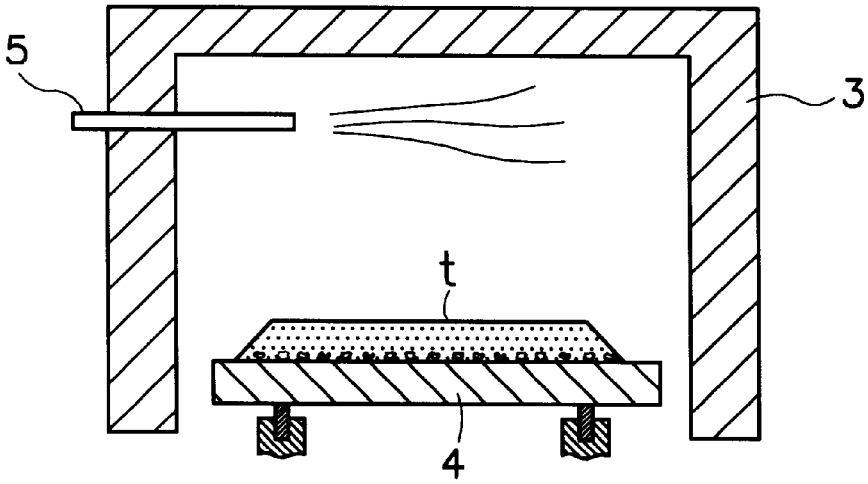
CONVENTIONAL

COMPARATIVE EXAMPLE

ROTARY HEARTH FURNACE AND METHOD OF OPERATING THE SAME

TECHNICAL FIELD

This invention is directed to a movable (rotary) hearth furnace which is suitably useful for the production of a reduced metal by reduction treatment of ore as a feed stock. Furthermore, the invention is directed to a method of the operation of such movable hearth furnace.

BACKGROUND ART

Crude steel is produced by those methods roughly grouped into a blast furnace-converter process and an electric furnace process. Of such methods, the electric furnace process gives steel by melting a starting iron material such as scrap or reduced iron with heat derived from electric energy and, where desired, by further refining the melt. In the electric furnace method, the scrap is now a dominant feed stock. Recently, however, the reduced iron has been in growing demand so as to compensate for shortage of the scrap and also to meet with the need for steel products of high quality.

One process for the production of reduced iron is disclosed for instance in Japanese Unexamined Patent Publication No. 63-108188. This prior art process is comprised of charging an iron ore and a solid charging material in a horizontally rotary hearth furnace, of stacking the respective layers one on the other, of heating the resulting layer from above by means of radiant heat transfer, thereby reducing the iron ore, whereupon a reduced iron is obtained.

In general, in a rotary hearth furnace for use in ore reduction, a series of operations such as stack of feed stock on a hearth, preheating, reduction and discharge is effected while the hearth is rotated once. In order to improve productivity to as high an extent as possible in keeping pace with such series of operations, a feed port 6 for charging feed stock and a discharge port 7 for taking out the treated reduced ore disposed adjacent to each other as shown in FIG. 1. On a rotary hearth 3 from the feed port 6 to the discharge port 7, as viewed in FIG. 1, is stacked feed stock a layer (in FIG. 2) t composed of an iron ore and a solid reducing material as seen in FIG. 2 that is taken along a line A—A which appears in FIG. 1. The feed stock is covered by a furnace body 3 lined on its upper surface and side surfaces with a refractory material, and a burner 5 is located upstream of the furnace body. By use of fuel gas, heavy oil or the like, the burner 5 heats up the feed stock t stacked on the rotary hearth 4. With such burner used as a source of heat, the feed stock stacked on the rotary hearth 4 is heated up so that the ore a is reduced by a carbon material in the feed stock.

Here, the inner furnace temperature is usually maintained at around 1300° C. Upon completion of the reduction treatment, the ore is converted to a reduced ore which, when taken as reduced out of the furnace, is vulnerable reoxidation owing to its high temperature and hence tends to suffer deteriorated quality of the finished steel product. The reduced ore of elevated temperature is also liable to render the discharge port 7 and other neighboring equipment and facilities susceptible to impairment or short service life. To cope with those defects, it has been considered thus far that a reduced ore could be cooled on the movable hearth with use of a cooler of an air, water or like type, followed by discharge and recovery of the cold steel product. This sort of countermeasure leaves the problem, however, that it calls for use of utilities such as gas, water and the like and moreover complicated equipment with added investment. Besides and disadvantageously, energy loss takes place unless good use is made of energy derived from heat exchange by gas, water or the like.

DISCLOSURE OF THE INVENTION

In order to eliminate the above noted problems, the present invention provides a rotary hearth furnace which can attain minimized energy loss and prevent deteriorated steel product quality that would arise from reoxidation of a reduced ore after discharge outside the furnace. The invention also provides a method of operating such rotary hearth furnace.

To solve the foregoing problems, sensible heat of reduced ore is transferred by heat exchange to those feed stocks subsequently charged before the reduced ore is discharged out of a movable (rotary) hearth furnace. The reduced ore is thus lowered in its temperature at the time it is discharged outside the furnace so that it can be protected from reoxidation. Moreover, since the feed stocks are heated up prior to stacking on the movable (rotary) hearth, the amount of burner fuel required for the feed stocks to be heated can be decreased.

Namely, the present invention provides a method of operating a movable hearth furnace which comprises the steps of supplying an ore for use as a feed stock in a movable furnace having a unidirectionally movable (rotary) hearth disposed therein, thereby stacking the ore on the hearth, and repeating a series of operations including preheating, reduction and discharge to thereby reduce the ore, wherein the feed stock subsequently supplied to the furnace is preheated by utilizing heat from applied by the finished reduced ore and is then stacked on the movable hearth.

In addition, the present invention provides a movable hearth furnace having a moving (rotary) hearth located to to carry a feed stock, and a furnace body disposed to cover the hearth, wherein the movable hearth furnace has a partition positioned in at least one zone between a feed port for supplying the feed stock and a discharge port for discharging the reduced ore and introducing to the hearth a feed stock subsequently supplied from the feed port and preheated by means of radiant heat transfer from the previously reduced ore.

BRIEF DESCRIPTION OF THE DRAWINGS

FIG. 2 is a view of the rotary hearth furnace shown in FIG. 1 but taken along a line A—A which appears in FIG. 1.

BEST MODE OF CARRYING OUT THE INVENTION

Figure 3:
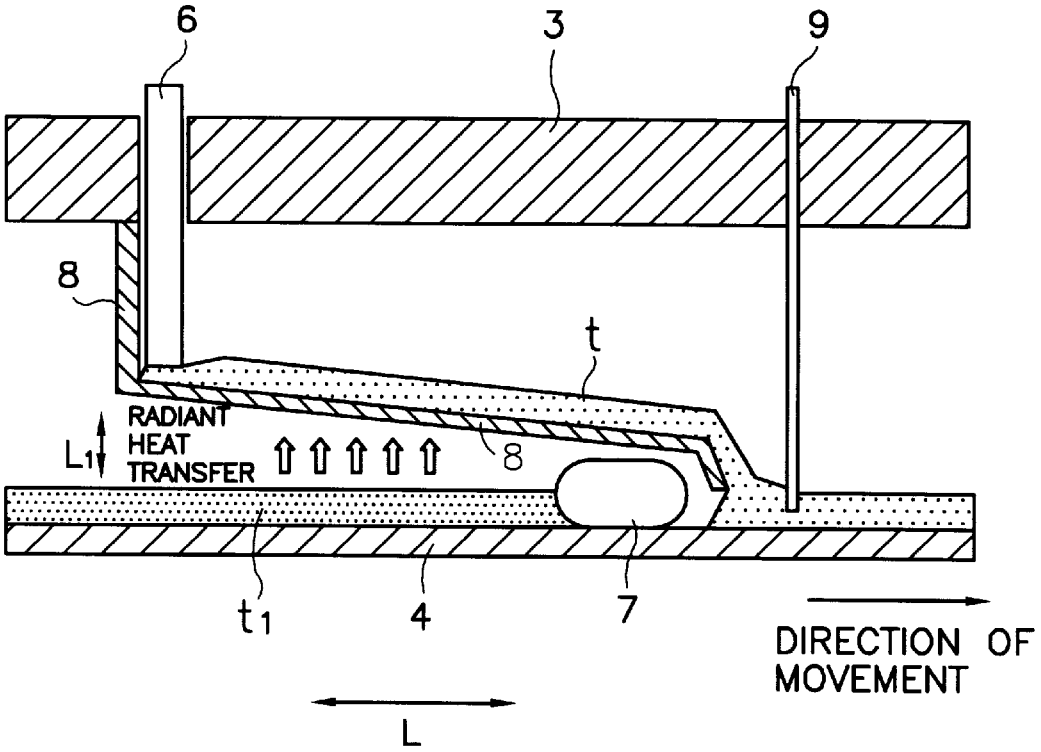
FIG. 3 is a view in side section of a rotary hearth furnace according to the present invention.

With reference to FIG. 3 of the drawings, the present invention is described below in greater detail.

Figure 1:
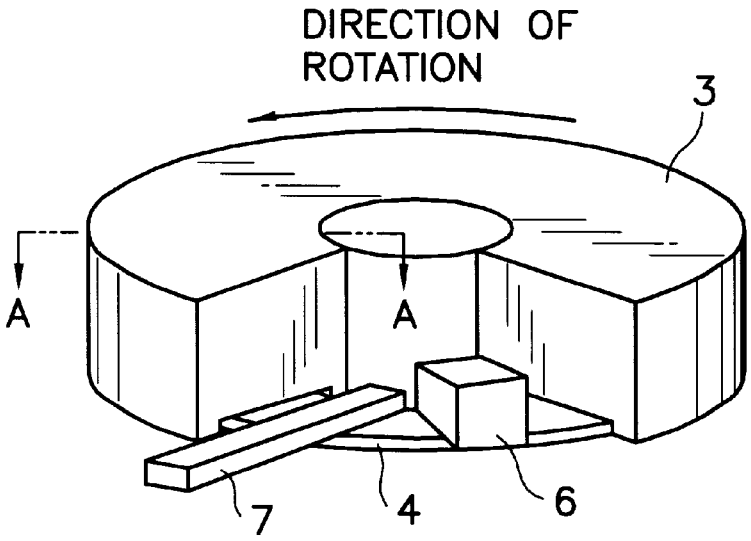
FIG. 1 is a view showing a rotary hearth furnace of a conventional type.

FIG. 3 shows important parts of a rotary hearth furnace provided in accordance with the invention. Designated at 6 in this figure is a feed port for charging an ore for use as a feed stock, at 7 a discharge port for discharging a reduced ore, at 8 a partition positioned between the feed port 6 and the discharge port 7. Partition 8 extends angularly downwardly and across the rotary hearth 4 and also has a role as a feeder for the feed stock in that direction, and at 9 a thermometer is provided for measuring the temperature of the feed stock placed on a hearth 4. As for other basic structural details, these correspond to those shown in FIGS. 1 and 2. A feed stock t composed of iron ore and a solid reducing material and supplied from the feed port 6 in the furnace, is caused to pass down along and above the sloped partition 8 and is introduced to the hearth 4 so that the feed stock undergoes reduction while being rotated once in a direction indicated by the arrow L in the furnace and then arrives at the discharge port 7. Since a reduced ore as reduced is caused to flow below the partition 8, a later-introduced portion of feed stock t introduced above such partition 8 is preheated by means of radiant heat transfer transferred from the already reduced ore. The temperature of the reduced ore drops during that time because of that transfer, whereupon such ore is finally taken out of the furnace at the discharge port 7 .

In the present invention, an overlap substantially horizontal distance $L_1$ (FIG. 3) required for heat exchange with the feed stock is set with the result that the temperature of the feed stock supplied from the feed port 6 can be raised to some extent while the latter material is being conveyed to the hearth 4. This leads to decreased consumption of a burner fuel (saved input energy) used in heating and reducing the feed stock and further to lowered temperature of a reduced ore when taken out of the discharge port 7. Hence, the reduced ore is protected from quality deterioration due to reoxidation after discharge. Also advantageously, lowered temperature of the already-reduced ore alleviates heat load on the discharge port 7 and on associated facilities, ultimately avoiding equipment damage such as thermal deformation and the like. The feed stock (iron ore plus solid reducing material) suitable for the invention is less than 10 mm in size in terms of a screen opening, preferably less than 8 mm, more preferably less than 3 mm.

EXAMPLES

Feed stocks were subjected to reduction treatment by the use of a rotary hearth furnace of a type shown in FIG. 3 above and having a hearth with a diameter of 2.2 m, an average cross distance (as determined outwardly peripherally of the hearth) of 1.3 m between a feed port and a discharge port, a vertical distance (on average material) L1 of 0.30 m between the reduced ore on its surface and the partition 8, a partition thickness of 0.12 m (made of alumina refractory) and a screw feeder disposed at the discharge port. The feed stock supplied at 6 in the furnace was a mixture of a fine iron ore and a fine coke, both of which were adjusted in size to a screen opening of less than 3 mm and mixed in a weight ratio of 8 to 2. The furnace temperature was maintained at 1300° C. by controlled burner combustion with use of a mixed gas of air and propane gas.

The fine iron ore and fine coke supplied in admixture in the furnace generated a CO gas during reduction, which gas is also made combustible in the presence of excess air derived from the burner. The retention time within the furnace was controlled to be for 27 minutes based on the speed of rotation of the hearth. Continuous operation was run for 20 days while the temperature of the feed stock was being measured.

Figure 4:
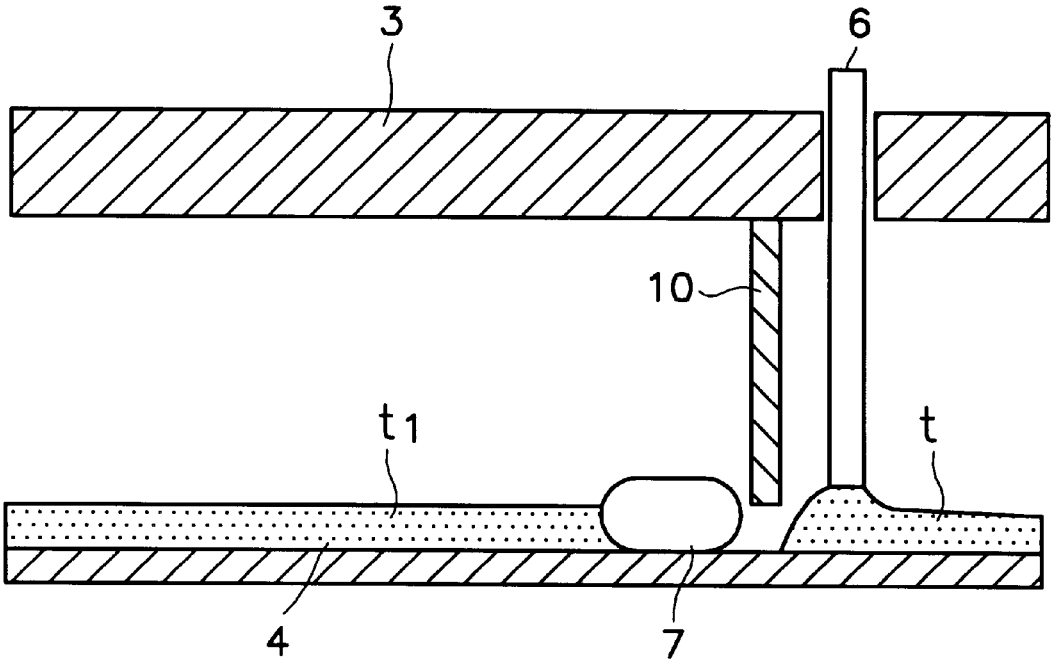
FIG. 4 is a view showing a rotary hearth furnace outside of the scope of the invention and used in a comparative example.

For comparative purposes, another operation was conducted under the same conditions set above but with use of a different furnace shown in FIG. 4 provided with a vertical partition 10 as seen in FIG. 4. It had no overlap distance L as in FIG. 3. differences of The results obtained are tabulated in Table 1.

In the case of the present invention as shown in FIG. 3, heat exchange was performed between the finished steel product (reduced ore) and the feed stock with the result that the steel product showed a lower temperature than the comparative example and least reoxidation outside the furnace. The rotary feeder located at the discharge port could be used without trouble involved during operation. The feed stock stacked on the rotary hearth was confirmed to have been heated up to 430° C. by heat exchange with the steel product. Heating by the burner was decreased to such an extent that the feed stock was preheated with eventual saving of propane in an amount of about 10% as compared to the comparative example. In contrast, the steel product of the comparative example had a discharge temperature of as high as 1200° C. and hence invited reoxidation outside the furnace, consequently causing a sharp decline in reduction ratio. Further, in FIG. 4 the feeder for use in steel product discharge gave rise to sticking on the 6th day of operation, resulting in malfunction.

TABLE 1

| | Invention Example | Comparative Example |
|---|---|---|
| Discharge temperature of steel product (° C.) | 750 | 1280 |
| Reduction degree of steel product immediately after discharge (%) | 93.1 | 93.2 |
| Reduction degree of steel product after cooling (%) | 92.2 | 85.3 |
| Temperature of feed stock layered on rotary hearth (° C.) | 430 | — |
| Life of screw feeder (day) | >20 | 5.3 |
| Flow rate of propane ($Nm^3$ / t) | 100 | 112 |

INDUSTRIAL APPLICABILITY

According to the present invention, iron ore can be reduced in a movable hearth furnace with minimum reoxidation and hence quality deterioration of reduced ore as well as impairment of reduced ore discharge equipment avoided and also with energy loss minimized.

What is claimed is:

1. A method of operating a movable hearth furnace, comprising the steps of:

feeding initial feed stock composed of an iron ore and a solid reducing material into a movable hearth furnace having a unidirectionally movable hearth disposed therein, thereby stacking said feed stock on said movable hearth; and repeating a series of operations including preheating, reduction and discharge of said iron ore and reducing material to thereby reduce said iron ore, further introducing a subsequent feed stock portion composed of an iron ore and a solid reducing material and supplied subsequently to said initial feed stock in said movable hearth furnace, preheating said subsequent feed stock portion by utilizing heat transferred from the finished reduced initial ore, and stacking said subsequent feed stock portion on said movable hearth for further reduction during movement of said movable hearth furnace, and subsequently discharging said initial feed stock portion from said furnace while transferring some of its heat to said subsequent feed stock portion.

2. A method of operating a movable hearth furnace as defined in claim 1, wherein said movable hearth is a rotary hearth.

3. A movable hearth furnace comprising:

a movable hearth located to stack thereon a feed stock composed of an iron ore and a solid reducing material; and a furnace body disposed to cover said movable hearth, said movable hearth furnace having a partition extending across at least one zone between a feed port for supplying the feed stock and a discharge port for discharging a reduced ore and introducing to said movable hearth a feed stock composed of an iron ore and a solid reducing material and supplied subsequently from said feed port and preheated by means of radiant heat transfer of a heat applied from the reduced ore as reduced.

4. A movable hearth furnace as defined in claim 3, wherein said movable hearth is a rotary hearth.

* * * * *

UNITED STATES PATENT AND TRADEMARK OFFICE

CERTIFICATE OF CORRECTION

PATENT NO. : 6,135,766
DATED : October 24, 2000
INVENTOR(S) : Kanji Takeda and Yoshitaka Sawa It is certified that error appears in the above-identified patent and that said Letters Patent is hereby corrected as shown below:

In Column 1, line 51, please change "ore a is reduced by a" to --ore is reduced by--; and line 55, after "vulnerable", please insert --to--.

In Column 2, line 17, please delete "its"; and line 31, please delete "applied by".

In Column 3, line 66, please change "differences of The" to --The differences of the--.

Signed and Sealed this

Eighth Day of May, 2001

*Attest:*

Nicholas P. Godici

NICHOLAS P. GODICI

*Attesting Officer*

*Acting Director of the United States Patent and Trademark Office*